United States Patent [19]

Kamiya et al.

[11] Patent Number: 4,522,485

[45] Date of Patent: Jun. 11, 1985

[54] COPYING MACHINE INCLUDING A DIELECTRIC COVERED METAL REFLECTIVE DEVICE

[75] Inventors: Osamu Kamiya; Nobuyuki Sekimura, both of Yokohama, Japan

[73] Assignee: Canon Kabushiki Kaisha, Tokyo, Japan

[21] Appl. No.: 429,145

[22] Filed: Sep. 30, 1982

Related U.S. Application Data

[63] Continuation of Ser. No. 195,491, Oct. 9, 1980, abandoned, which is a continuation of Ser. No. 30,855, Apr. 17, 1979, abandoned.

[30] Foreign Application Priority Data

Apr. 24, 1978 [JP] Japan ..... 53-48510
Nov. 6, 1978 [JP] Japan ..... 53-136408

[51] Int. Cl.[3] ..... G03G 15/04

[52] U.S. Cl. ..... 355/11; 350/642; 355/66; 355/71

[58] Field of Search ..... 355/3 R, 11, 30, 49, 355/51, 57, 60, 65, 66, 67, 71; 350/290

[56] References Cited

U.S. PATENT DOCUMENTS 3,143,921 8/1964 Russell ..... 355/30
3,944,320 3/1976 McLintic ..... 350/290 X
4,082,413 4/1978 Austin et al. ..... 350/290 X
4,088,884 5/1978 Rast et al. ..... 350/290 X
4,132,477 1/1979 Watabe et al. ..... 355/11

OTHER PUBLICATIONS

Soviet Journal of Quantum Electronics; "Possibility of Suppression of Reflection Peaks In Transmission Bands of Dielectric Mirrors"; Feb. 1975; vol. 4, No. 8, pp. 1032–1034.

*Primary Examiner*—Fred L. Braun
*Attorney, Agent, or Firm*—Fitzpatrick, Cella, Harper & Scinto

[57] ABSTRACT

A copying machine has at least one metal surface of high reflectance provided with a dielectric multilayer film vapor deposited thereon. The dielectric film has a wavelength selectivity and serves to match the wavelength characteristics of the light source used in the copying machine to the sensitivity characteristics of the photosensitive medium used in the same copying machine. Thus, in the copying machine, the spectral sensitivity characteristics get adjusted to the optimum by the particular effect of the metal reflective surface or by a synergistic effect of two or more such reflective metal surface.

14 Claims, 15 Drawing Figures

I

II

III

IV

V

VI

VIII

IX

COPYING MACHINE INCLUDING A DIELECTRIC COVERED METAL REFLECTIVE DEVICE

This is a continuation of application Ser. No. 195,491, filed Oct. 9, 1980, now abandoned which was a continuation of application Ser. No. 30,855, filed Apr. 17, 1979 now abandoned.

BACKGROUND OF THE INVENTION

1. Field of the Invention

The present invention relates in a copying machine of the type which comprises one or more reflective metal surfaces each having a multilayer film to compensate for the mismatch in spectral sensitivity characteristics between the light source and photosensitive medium in the copying machine.

2. Description of the Prior Art

In the art of copying machines and the like it is well known that an original in a certain color can not be copied due to the particular wavelength characteristics which the light source shows and the particular sensitivity characteristics which the photosensitive medium shows in the optical system of the copying machine. Here and hereinafter the term "optical system" should be understood to include light source, photosensitive medium and other optical members commonly used in a copying machine.

This unfavorable phenomenon is seen, for example, when a halogen lamp is used as the light source and a CdS series photosensitive medium is used as the light receiving part. In this case, characters and figures written in red on the original come out very faintly or do not come out at all in the copy as far as the red part is concerned. This is attributable to a combined effect of the wavelength characteristics of the light source and the sensitivity characteristics of the photosensitive medium. A halogen lamp has its maximum emission energy in the infrared spectral range ranging from 800 mμ to 900 mμ at the filament temperature of about 3000° K normally used. The emission energy decreases gradually at a constant rate toward the short wavelength side. On the other hand, CdS photosensitive medium has such spectral sensitivity which becomes high in the range of from red to near infrared. As a result, characters and figures in red on an original are overexposed to light as compared with those in blue and green on the same original.

A similar phenomenon is seen also in the optical system comprising a fluorescent lamp as the light source and a Se photosensitive medium as the light receiving part. In this case, since the fluorescent lamp is rich in blue energy and the sensitivity of Se photosensitive medium is particularly high to blue, there is caused an overexposure to blue light so that characters and figures written in blue in the original are difficult to copy.

Therefore, some means should be provided to reduce or eliminate the above mentioned phenomenon whenever there exists a mismatch between the wavelength characteristics of light beam entering the optical system and the sensitivity characteristics of the photosensitive medium then used.

One of the known solutions to the problem is to interpose an absorption filter having wavelength selectivity to light in the optical path. Because of expensiveness, such selective absorption filter is generally disposed at a position where the beam diameter becomes minimum in the optical path extending from the light source to the photosensitive medium. For example, it is positioned in or near the imaging lens. DOS No. 2,350,281 (filed on Oct. 6, 1973) has disclosed a reflection type projection lens system having a built-in filter. However, as pointed out in the specification by the inventor himself, the novel lens system disclosed therein has a disadvantage that the transmissivity of the light beam passing through the lens system is greatly decreased. This is because the imaging beam of light has to pass through the filter twice, once each at entrance time and at exit time. Another disadvantage of the solution is that the image formation power of the lens system is substantially reduced by reflection of light on the filter surface.

It is also known to interpose a dielectric multilayer film as a reflection mirror or filter in the optical path so as to adjust the quantity of light for every wavelength. One of such multilayer films is a dielectric multilayer interference film which possesses a property similar to that of a dichroic mirror for color separation used in a color television camera. However, this reflective multilayer film is low in reflectance or reflection factor. In order to obtain the same degree of reflection factor as that of a simple metal reflection mirror, the reflective multilayer film must be composed of ten or more dielectric layers which makes the film expensive.

We, the applicants of the present application have already proposed in our prior application, U.S. application Ser. No. 964,986 (filed on Nov. 30, 1978) that the sensitivity characteristics of the photosensitive medium should be compensated by a novel type of multilayer interference film. The film is prepared by laminating alternate high and low refractive layers on a glass substrate, each refractive layer having an optical film thickness corresponding to $\frac{1}{4}$ of the design wavelength. Generally, glass is a material of low reflectance. The prior invention aimed at increasing the reflectance excepting a predetermined range of wavelength by providing such multilayer interference film on a glass substrate. The present invention aims at attaining the same effect in another way. According to the invention there is used, as the substrate, not glass but a metal surface which has a higher reflectance than glass. By using a high reflective metal surface as the substrate and reducing the reflectance selectively for a predetermined range of wavelength, the same effect aimed at by the prior invention can be attained. The metal surface used as a substrate in the invention is formed, for example, by vapour depositing a metal film on a glass plate. In other words, the metal surface is generally supported by glass.

SUMMARY OF THE INVENTION

Accordingly, it is a general object of the invention to provide a copying machine in which the wavelength characteristics of the light source and the sensitivity characteristics of photosensitive medium are compensated by at least one metal surface mirror with a multilayer interference film vapour deposited thereon.

To attain the object according to the invention, the reflectance of the mirror is decreased selectively as for a predetermined range of wavelength by laminating alternate high and low refractive layers on a metal substrate. The alternate high and low refractive layers form a multilayer dielectric film. Preferably, the top one of the refractive layers is a high refractive layer.

According to an aspect of the invention, two or more such metal surface mirrors each having a multilayer interference film vapour deposited thereon are used to attain the above mentioned object by a synergistic effect of these mirrors.

Other and further objects, features and advantages of the invention will appear more fully from the following description taken in connection with the accompanying drawings.

DESCRIPTION OF THE PREFERRED EMBODIMENTS

Figure 1A:
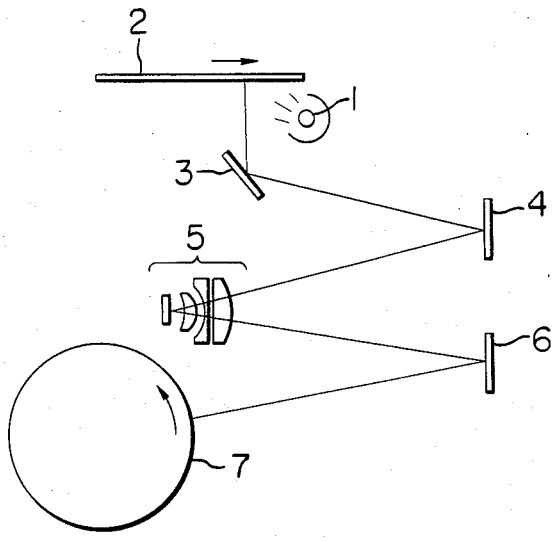
FIGS. 1(A) and 1(B) are schematic illustrations of the optical systems of copying machines in which the present invention is embodied.

Referring first to FIG. 1(A) there is shown a copying machine in which the present invention is embodied. The copying machine comprises a stationary light source 1, a movable original table surface 2, stationary reflection mirrors 3, 4, 6 and a fixed lens system 5. Designated by 7 is a moving photosensitive medium which is rotated in the direction of the arrow to make a copy of the original on the original table 2 moving in the direction also indicated by an arrow.

Figure 1B:
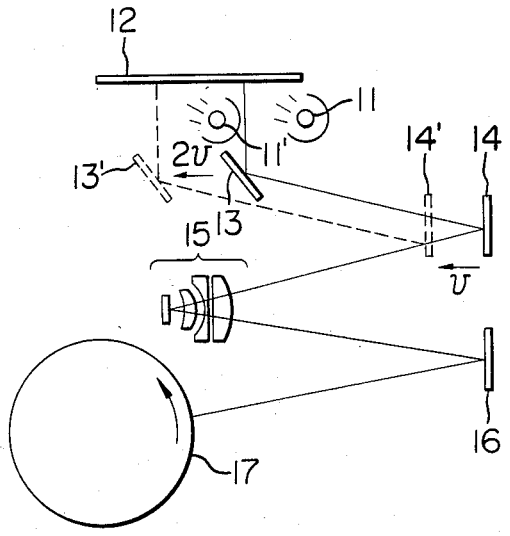

FIG. 1(B) shows another type of a copying machine in which the present invention is embodied. Reference numeral 11 designates a scanning light source 12 is a stationary original table surface, 13 is a first scanning reflection mirror and 14 is a scanning reflection mirror. The copying machine further includes a stationary lens system 15, a fixed reflection mirror 16 and a moving photosensitive medium 17. To carry out slit exposure scanning, the first and second scanning reflection mirrors 13 and 14 are moved along the stationary original table surface 12 while maintaining the relative speed ratio of 2:1 in the same direction.

In FIGS. 1(A) and (B), the fixed lens system 5 or 15 is shown as an in-mirror lens, that is, an optical system comprising a reflection mirror located in the position of diaphragm and a lens system arranged only at one side of the diaphragm. Although this system is not of the type comprising a lens system symmetrically arranged relative to the diaphragm plane, it has virtually the same function as that of the symmetrically arranged lens system. Of course, the use of a in-mirror lens is limitative. The fixed lens system 5 or 15 may be also of transmission type.

Figure 2:
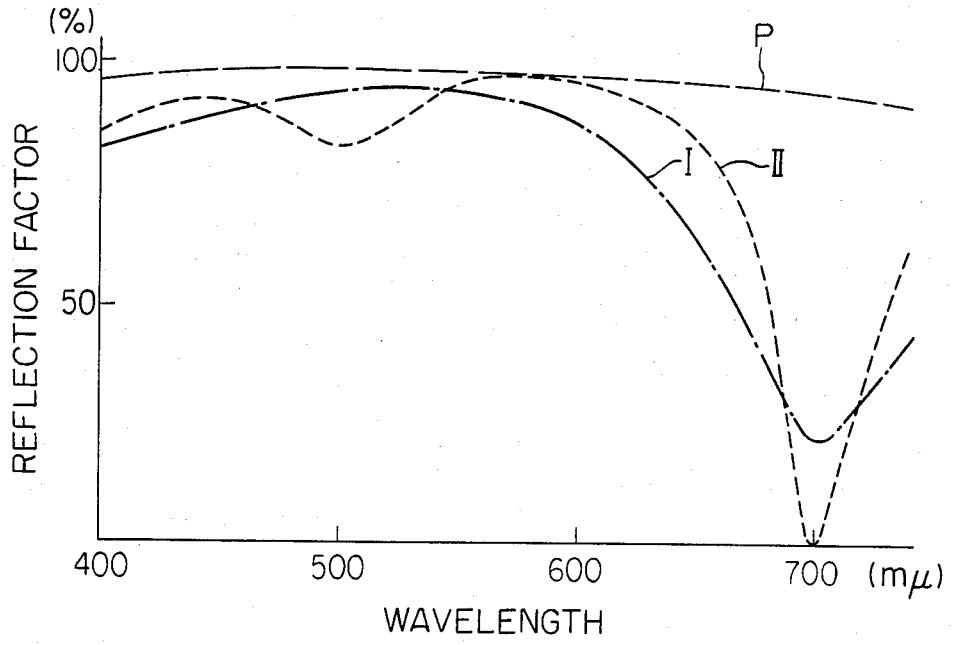
FIGS. 2 and 3 show spectral reflection characteristic curves of reflective mirrors used in the optical system in accordance with the invention.

Reflective mirrors used in the optical system according to the invention show particular characteristics of spectral reflection factor different from the prior art ones. These are shown in FIG. 2 with the reflection facter as the ordinate and the wavelength (mμ) as the abscissa. In FIG. 2, the reflection factor characteristic curve P is of the intensified reflective mirror according to the prior art while the curves 1 and 11 are reflective mirrors according to the present invention. Mirror data of the curves 1 and 11 are shown in the following Table I.

TABLE I

| | Spectral Characteristic Curve I | | Spectral Characteristic Curve II | |
|---|---|---|---|---|
| | Refractive index | Optical film thickness | Refractive index | Optical film thickness |
| Metal substrate layer | 1.53–7.0i (λ = 700 mμ) | | 1.55–7.0i (λ = 700 mμ) | |
| 1st dielectric layer | 2.25 | 142 mμ | 2.25 | 142 mμ |
| 2nd dielectric layer | 1.38 | 175 mμ | 1.38 | 175 mμ |
| 3rd dielectric layer | 2.25 | 175 mμ | 2.25 | 175 mμ |
| 4th dielectric layer | — | — | 1.38 | 175 mμ |
| 5th dielectric layer | — | — | 2.25 | 175 mμ |
| Air layer | 1.0 | | 1.0 | |

*Fundamental wavelength λ is 700 mμ.

As seen from FIG. 2 and Table I, the reflective mirrors according to the invention show a remarkably reduced reflectance at and near the fundamental wavelength or 700 mμ. Therefore, by using such reflective mirror in an optical system comprising a combination of a halogen lamp and a CdS photosensitive medium a substantial reduction of quantity of light in the range of from red to near infrared can be attained. Accordingly, this is effective to prevent the unfavorable phenomenon that characters and figures in red or red series color come out only faintly or do not come out at all in the copy.

Figure 3:
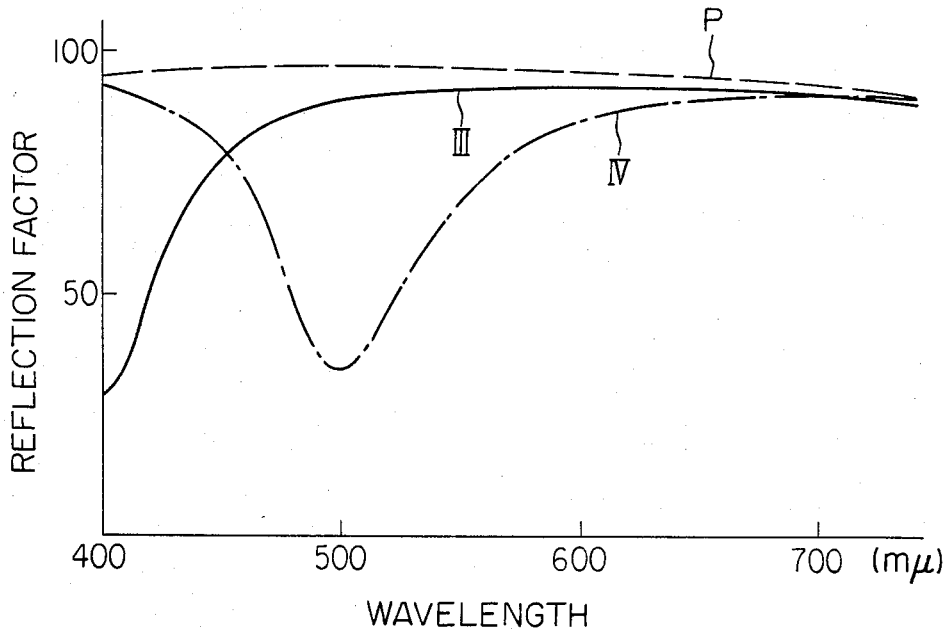

Spectral reflectance characteristics of other embodiments of reflective mirror according to the invention are shown in FIG. 3 in which the curve III is for the fundamental wavelength of 400 mμ and the curve IV is for the fundamental wavelength of 500 mμ. Numerical data given in the following Table II shows the structures of embodiments from which the curves III and IV in FIG. 3 were obtained.

TABLE II

| | Spectral Characteristic Curve III | | Spectral Characteristic Curve IV | |
|---|---|---|---|---|
| | Refractive index | Optical film thickness | Refractive index | Optical film thickness |
| Metal substrate layer | 0.40–3.92i (λ = 400 mμ) | | 0.62–4.80i (λ = 500 mμ) | |
| 1st dielectric layer | 2.35 | 66 mμ | 2.25 | 92 mμ |
| 2nd dielectric layer | 1.38 | 100 mμ | 1.46 | 125 mμ |
| 3rd dielectric layer | 2.35 | 100 mμ | 2.25 | 125 mμ |
| Air layer | 1.0 | | 1.0 | |

In general, each dielectric layer has to have such film thickness corresponding to a quarter ($\frac{1}{4}$) of the fundamental wavelength λ wherein the fundamental wavelength λ is a wavelength lying about the center of the wavelength range at which the reflectance should be reduced. As for the first dielectric layer which is in contact with the metal substrate surface, it has to have a film thickness somewhat less than the above defined thickness $\frac{1}{4}\lambda$ taking into account the phase jump from the metal surface to the dielectric film surface. More particularly, letting the complex refractive index of the metal surface at the fundamental wavelength λ be $n_o - i^k$, the optical film thickness of the first layer, n is given by:

$$nd = \frac{\lambda}{4\pi}\left\{\pi + \tan^{-1}\frac{2k \cdot n_H}{(n_H^2 - n_o^2) - k^2}\right\}$$

wherein nH is the refractive index of the high refractive layer, which is, in this case, the same as the refractive index n of the first dielectric layer.

For the optical system comprising a combination of a halogen lamp light source and a CdS photosensitive medium, the fundamental wavelength λ mentioned above should be selected to be between infrared and near infrared (600 mμ–800 mμ). For the optical system comprising a combination of a fluorecent lamp light source and a Se photosensitive medium, the fundamental wavelength λ should be in the blue color range (350 mμ–500 mμ).

For the purpose of the invention it is preferable that the last one of the dielectric layers be a high refractive layer.

The high refractive layer must have a refractive index higher than 1.6 while the refractive layer has a refractive index less than 1.5. To form the high refractive layer there may be used, for example, $CeO_2$, $ZnO_2$ and $TiO_2$. The low refractive layer may be formed by using, for example, $MgF_2$ $SiO_2$. As the metal mirror, there may be used not only an aluminum mirror but also any other mirror of high reflectance such as silver and chrome mirrors.

Figure 4:
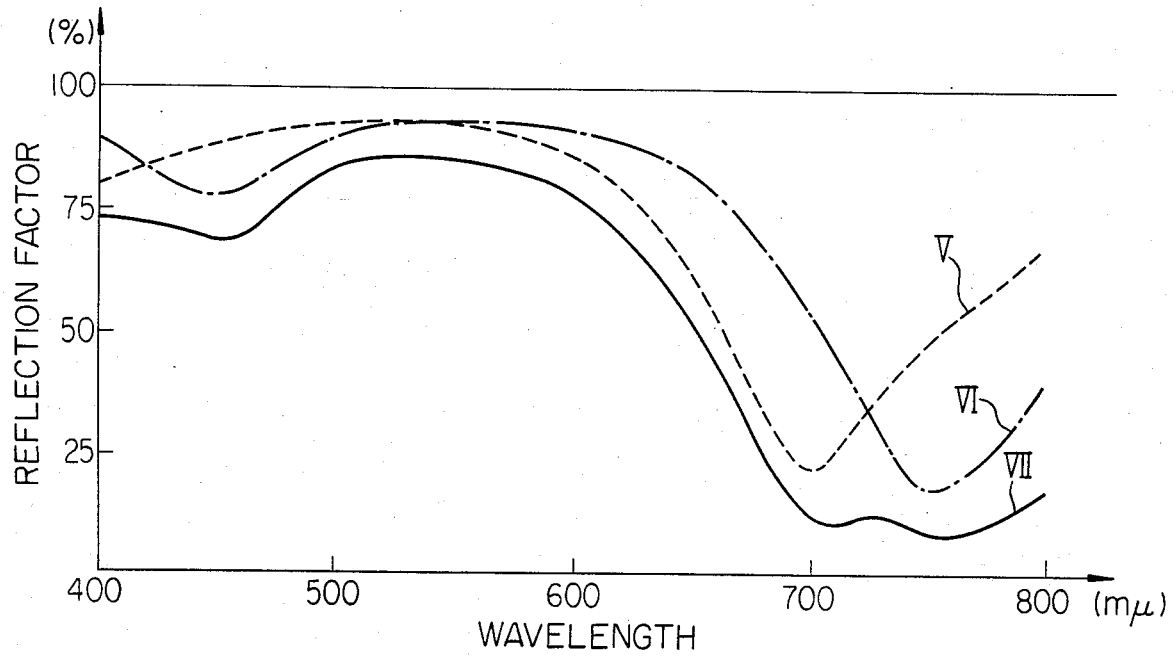
FIGS. 4 and 5 are spectral reflection characteristic curves showing synergistic effects of various combinations of two different reflective mirrors in accordance with the invention.
Figure 5:
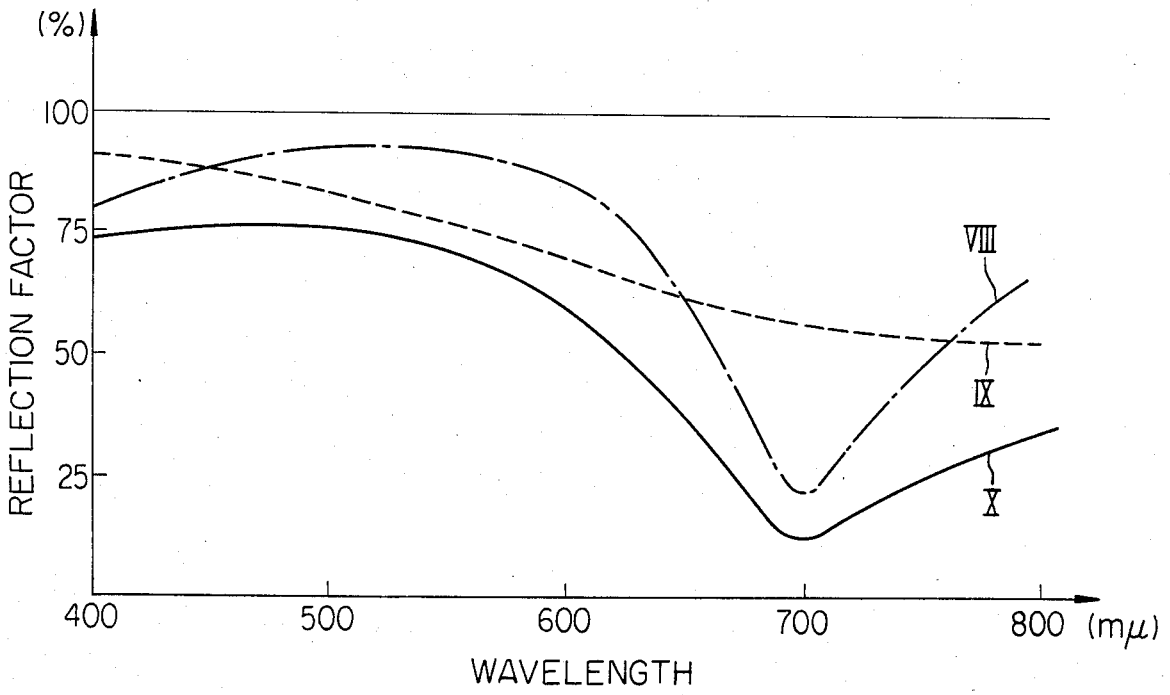
Figure 6A:
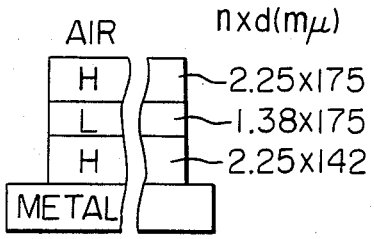
FIGS. 6(A) to 6(H) show the compositions of dielectric multilayer films used in FIGS. 2 to 5 respectively.
Figure 6B:
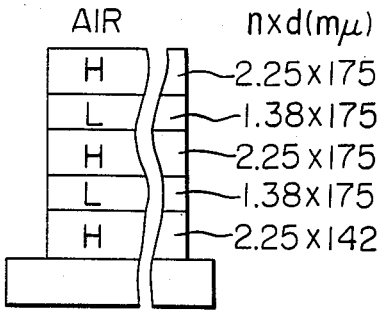
Figure 6C:
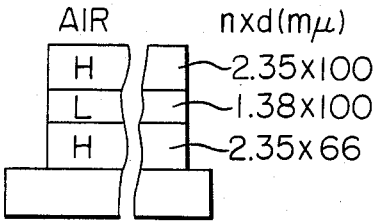
Figure 6D:
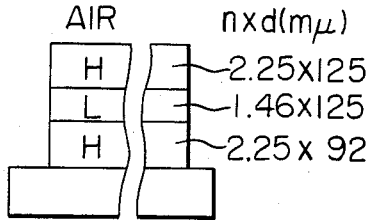
Figure 6E:
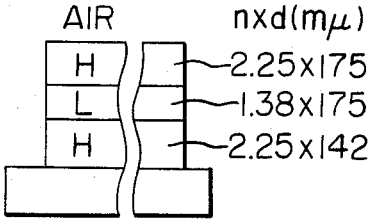
Figure 6F:
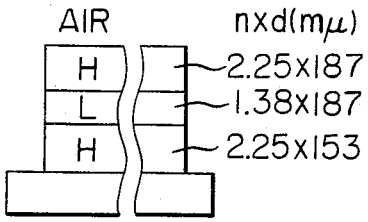
Figure 6G:
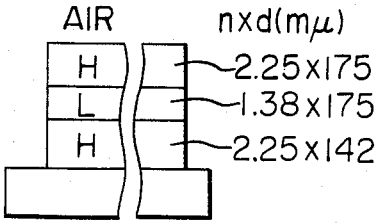
Figure 6H:
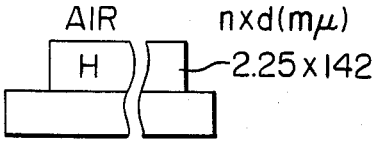
Figure 7:
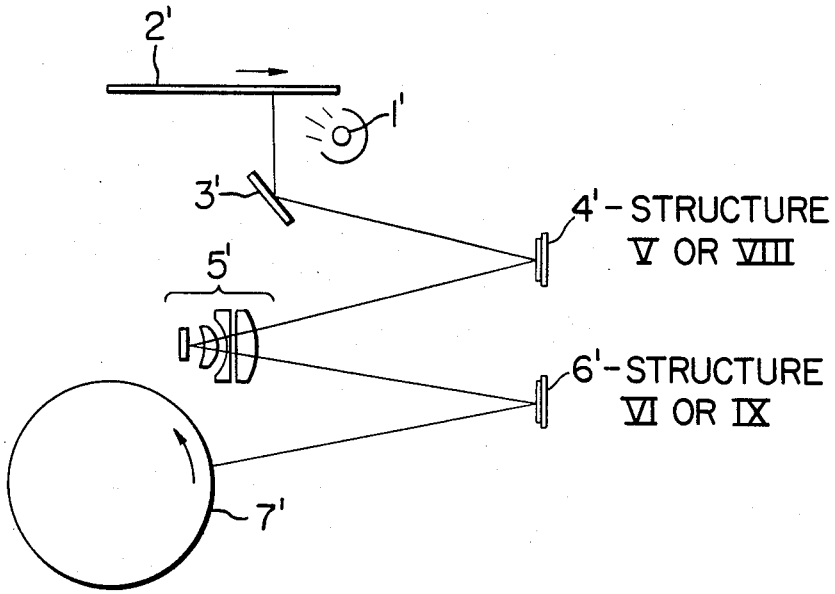
FIG. 7 depicts alternate embodiments of the present invention.

The number of the reflective mirror surfaces used in an optical system according to the invention is never limited to only one. Two or more reflective mirror surfaces can be arranged in an optical system to obtain the desired spectral reflectance characteristics by an synergistic effect of two or more mirrors in accordance with the principle of the invention. In this case, the first and second mirrors may be the same or different from each other in structure and in composition of their multilayer films. FIGS. 4, 5, and 7 and Tables III and IV show some embodiments of such combination of two different mirrors in accordance with the invention. The elements depicted in FIG. 7 with prime numbers generally correspond to the elements shown in FIG. 1(A) without prime numbers.

In the embodiment shown in FIG. 4, the first mirror the structure of which is shown in Table III as Structure V has the characteristic curve V. The second mirror whose structure is shown as Structure VI in Table III has the characteristic curve VI in FIG. 4. The combined effect of the two mirrors V and VI brings forth the characteristic curve VII in FIG. 4.

In this embodiment, the design wavelength was 700 mμ for Structure V and 750 mμ for Structure VI. The resultant characteristic curve VII in FIG. 4 clearly shows that the reflection factor dropped sharply at and near the design wavelength 700 mμ–750 mμ. By using such combination of reflecting mirrors in an optical system comprising a combination of halogen lamp and CdS photosensetive medium in accordance with the invention, a substantial reduction of quantity of light in the range of from red to near infrared can be attained to prevent the undersirable phenomenon that characters and figures in red series color come out only faintly or do not come out at all in the copy.

TABLE III

| | Structure V | | Structure VI | |
|---|---|---|---|---|
| | Refractive index | Optical film thickness | Refractive index | Optical film thickness |
| Metal substrate layer | 1.53–7.0i (λ = 700 mμ) | | 1.80–7.12i (λ = 750 mμ) | |
| 1st dielectric layer | 2.25 | 142 mμ | 2.25 | 153 mμ |
| 2nd dielectric layer | 1.38 | 175 mμ | 1.38 | 187 mμ |

TABLE III-continued

| | Structure V | | Structure VI | |
|---|---|---|---|---|
| | Refractive index | Optical film thickness | Refractive index | Optical film thickness |
| 3rd dielectric layer | 2.25 | 175 mμ | 2.25 | 187 mμ |
| Air layer | 1.00 | — | 1.00 | — |

Another embodiment of a combination of two reflective mirrors according to the invention is shown in FIG. 5 and Table IV. Characteristic curve VIII in FIG. 5 was obtained from the first mirror of Structure VIII in Table IV and curve IX from the second mirror of Structure IX. The synergistic effect of the two mirrors brought forth the characteristic curve X. In this embodiment, the design wavelength was 700 mμ for both of Structures VIII and IX. The resultant characteristic curve X clearly shows that the reflections factor dropped sharply at and near the design wavelength. Therefore, the use of this combination of the reflecting mirrors has a remarkable effect on depression of the above mentioned unfavorable phenomenon in a copying machine using a combination of halogen lamp and CdS photosensitive medium.

FIG. 6 schematically shows the arrangements of dielectric layers in the above described embodiments I to VI, VIII and IX.

TABLE IV

| | Structure VIII | | Structure IX | |
|---|---|---|---|---|
| | Refractive index | Optical film thickness | Refractive index | Optical film thickness |
| Metal substrate layer | 1.55–7.0i (λ = 700 mμ) | | 1.55–7.0i (λ = 700 mμ) | |
| 1st dielectric layer | 2.25 | 142 mμ | 2.25 | 142 mμ |
| 2nd dielectric layer | 1.38 | 175 mμ | — | — |
| 3rd dielectric layer | 2.25 | 175 mμ | — | — |
| Air layer | 1.00 | — | 1.00 | — |

As will be understood from the foregoing, the present invention provides a copying machine which is able to make a good match between wavelength characteristics of the light source and sensitivity characteristics of the photosensitive medium. According to the invention, the intended matching of characteristics can be attained by using at least one metal reflective surface provided with a multilayer film. The multilayer film is formed by vapour depositing on the metal substrate surface high refractive layers and low refractive layers alternately, preferably starting with a high refractive layer. Use of two or more such metal reflective surfaces bring forth a synergistic effect wherein the wavelength characteristics of light source and the sensitivity characteristics of photosensitive medium are well matched. The copying machine according to the invention is simple in structure and excellent in weather resistance with the metal reflective surface(s) being protected against damage.

While the invention has been particularly shown and described with reference to preferred embodiments thereof, it will be understood by those skilled in the art that the foregoing and other changes in form and details can be made therein without departing from the spirit and scope of the invention.

What we claim is:

1. A copying machine comprising an original table on which an original to be copied is laid; a lens system; a photosensitive medium which has characteristics of high sensitivity to light in a certain wavelength range; a light source for illuminating an object to be copied; and reflective means for reflecting light from the object to said photosensitive medium, said reflective means comprising a metal surface having a dielectric film provided thereon, wherein said dielectric film decreases the reflection factor of said metal surface for light of a wavelength to which said photosensitive member is highly sensitive, while retaining a relatively higher reflection factor for other light, and wherein said metal absorbs non-reflected light, so that the spectral wavelength characteristics of light coming from the light source match with the spectral sensitivity characteristics of said photosensitive medium.

2. A copying machine as claimed in claim 1, wherein said metal surface is provided on a glass substrate.

3. A copying machine as claimed in claim 1, wherein said dielectric film comprises a plurality, less than five, of alternate high and low refractive index layers.

4. A copying machine as claimed in claim 1, wherein said metal is aluminum.

5. A copying machine as claimed in claim 1, wherein said metal is silver.

6. A copying machine as claimed in claim 1, wherein said reflective means has at least two reflective metal surfaces, with a dielectric film formed, respectively, on each said metal surface.

7. A copying machine as claimed in claim 6, wherein said two or more reflective surfaces have different spectral reflectance characteristics.

8. A copying machine as claimed in claim 7, wherein the dielectric film on each reflective metal surface comprises alternate high and low refractive layers with the condition that the first layer in contact with said metal surface be a high refractive layer.

9. A copying machine as claimed in claim 8, wherein the last one of said alternate high and low refractive layers in said dielectric film is a high refractive layer.

10. A copying machine as claimed in claim 1, wherein said dielectric film comprises alternate high and low refractive layers with the condition that the first layer in contact with said metal reflective surface be a high refractive layer.

11. A copying machine as claimed in claim 10, wherein each the layer in said dielectric film has an optical film layer thickness approximately corresponding to $\frac{1}{4}$ of the design wavelength $\lambda$ which is about the center value of the wavelength range at which a reduction of reflectance is desired, with the provision that the first layer in contact with said metal reflective surface has an optical film layer thickness somewhat less than $\frac{1}{4}\lambda$.

12. A copying machine comprising an original table on which an original to be copied is laid; a lens system; a photosensitive medium which has characteristics of high sensitivity to light in a certain wavelength range; a light source; at least one metal reflective surface and a dielectric film provided on said metal reflective surface and serving to match the wavelength characteristics of beam of light coming from an object with the spectral sensitivity characteristics of said photosensitive medium, wherein said dielectric film comprises alternate high and low refractive layers with the condition that the first layer in contact with said metal reflective surface be a high refractive layer, wherein each layer in said dielectric film has an optical film layer thickness approximately corresponding to $\frac{1}{4}$ of the design wavelength $\lambda$ which is about the center value of the wavelength range at which a reduction of reflectance is desired, with the provision that the first layer in contact with said metal reflective surface has an optical film layer thickness somewhat less than $\frac{1}{4}$; and wherein the optical film layer thickness, nd of said first layer is given by:

$$nd = \frac{\lambda}{4\pi}\left\{\pi + \tan^{-1}\frac{2k \cdot n_H}{(n_H^2 - n_o^2) - k^2}\right\}$$

wherein, n: refractive index of the first layer, d: geometrical film layer thickness of the first layer, $n_o$, k: coefficients of the complex refractive index $n_o - i^k$ on the metal reflective surface at the wavelength $\lambda$, and $n_H$: refractive index of the high refractive layer.

13. A copying machine as claimed in claim 11 or 12, wherein the last one of alternate high low refractive layers in said dielectric film is a high refractive layer.

14. An optical system comprising:

a light source for illuminating an object;

a photosensitive medium for sensing the light from said object, said photosensitive medium having characteristics of high sensitivity to light in a certain wavelength range; and reflective means disposed in the optical path between said light source and said photosensitive medium, said reflective means comprising a reflective metal surface having a dielectric film provided thereon, wherein said dielectric film decreases the reflection factor of said metal surface for light of a wave length to which said photosensitive member is highly sensitive, while retaining a relatively higher reflection factor for other light, and wherein said metal absorbs non-reflection light, so that the spectral wavelength characteristics of a beam of light coming from said light source match with the spectral sensitivity characteristics of said photosensitive medium.

* * * * *

UNITED STATES PATENT AND TRADEMARK OFFICE

CERTIFICATE OF CORRECTION

PATENT NO. : 4,522,485

DATED : June 11, 1985

INVENTOR(S) : OSAMU KAMIYA, ET AL.

It is certified that error appears in the above-identified patent and that said Letters Patent is hereby corrected as shown below:

Col. 3, line 37, after "source" insert -- , --;
line 55, change "a" to --an--;
line 65, change "1" to --I--; and
change "11" to --II--;
line 67, change "1" to --I--; and
change "11" to --II--.

Col. 4, line 7, change "1.53 - 7.0i" to --1.55 - 7.0i --
line 19, change "or" to --of--.

Col. 5, line 9, change "fluorecent" to --fluorescent--;
line 21, after "$MgF_2$" insert --or--;
line 66, change "1.53 - 7.0i" to --1.55 - 7.0i--.

Col. 6, lines 6-7, under "Structure VI", place "187m" under the appropriate Column "Optical film thickness";
line 20, change "reflections" to --reflection--.

Signed and Sealed this

*Seventeenth* Day of *June 1986*

[SEAL]

*Attest:*

DONALD J. QUIGG

*Attesting Officer*

*Commissioner of Patents and Trademarks*